US010242789B2

(12) United States Patent
Maki et al.

(10) Patent No.: US 10,242,789 B2
(45) Date of Patent: Mar. 26, 2019

(54) METHOD FOR MANUFACTURING CERAMIC ELECTRONIC COMPONENT, AND CERAMIC ELECTRONIC COMPONENT

(71) Applicant: MURATA MANUFACTURING CO., LTD., Kyoto-fu (JP)

(72) Inventors: Yoshifumi Maki, Nagaokakyo (JP); Takuya Ishida, Nagaokakyo (JP); Hirotsugu Tomioka, Nagaokakyo (JP); Shinya Hirai, Nagaokakyo (JP); Daisuke Katayama, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 15/175,655

(22) Filed: Jun. 7, 2016

(65) Prior Publication Data

US 2016/0372255 A1 Dec. 22, 2016

(30) Foreign Application Priority Data

Jun. 16, 2015 (JP) ..... 2015-120751
Feb. 9, 2016 (JP) ..... 2016-022323

(51) Int. Cl.
*H01F 27/24* (2006.01)
*H01F 27/28* (2006.01)
(Continued)

(52) U.S. Cl.
CPC ..... *H01F 27/2804* (2013.01); *H01F 17/0006* (2013.01); *H01F 17/0033* (2013.01);
(Continued)

(58) Field of Classification Search
CPC ..... H01F 5/00; H01F 27/00–27/36
(Continued)

(56) References Cited

U.S. PATENT DOCUMENTS 7,154,374 B2 * 12/2006 Ritter ..... H01C 1/14 338/323
9,666,366 B2 * 5/2017 Ritter ..... H01G 4/008
(Continued)

FOREIGN PATENT DOCUMENTS

JP S63-85078 A 4/1988
JP H11-121234 A 4/1999
(Continued)

OTHER PUBLICATIONS

Notification of the First Office Action issued by the State Intellectual Property Office of the People's Republic of China dated Nov. 16, 2017, which corresponds to Chinese Patent Application No. 201610421659.3 and is related to U.S. Appl. No. 15/175,655.
(Continued)

*Primary Examiner* — Tuyen Nguyen
(74) *Attorney, Agent, or Firm* — Studebaker & Brackett PC

(57) ABSTRACT

A manufacturing method that is capable of forming an electrode on any part of a surface of a sintered ceramic body in accordance with a simple approach, and a ceramic electronic component manufactured by the method. The method for manufacturing a ceramic electronic component includes steps of preparing a sintered ceramic body containing a metal oxide, irradiating an electrode formation region on a surface of the ceramic body with a laser to partially lower resistance of the ceramic body, thereby forming a low-resistance portion, and subjecting the ceramic body to plating to deposit a plated metal serving as an electrode on the low-resistance portion, and growing the plated metal to extend over the entire electrode formation region.

10 Claims, 9 Drawing Sheets

(51) Int. Cl.
*H01F 41/04* (2006.01)
*H01F 17/00* (2006.01)
*H01F 17/04* (2006.01)
*H01F 27/29* (2006.01)

(52) U.S. Cl.
CPC ..... *H01F 17/045* (2013.01); *H01F 27/24* (2013.01); *H01F 27/292* (2013.01); *H01F 41/041* (2013.01); *H01F 41/046* (2013.01); *H01F 2027/2809* (2013.01)

(58) Field of Classification Search
USPC ..... 336/65, 83, 200, 232, 233–234
See application file for complete search history.

(56) References Cited

U.S. PATENT DOCUMENTS

| | | | | |
|---|---|---|---|---|
| 2011/0012707 | A1* | 1/2011 | Koto ..... | H01C 7/043 338/22 R |
| 2016/0090661 | A1 | 3/2016 | Kitada et al. | |

FOREIGN PATENT DOCUMENTS

| | | | |
|---|---|---|---|
| JP | H11-135350 | A | 5/1999 |
| JP | H11-176685 | A | 9/1999 |
| JP | 2000-223342 | A | 8/2000 |
| JP | 2000-243629 | A | 9/2000 |
| JP | 2002-050534 | A | 2/2002 |
| JP | 2004-040084 | A | 2/2004 |
| JP | 2005-051050 | A | 2/2005 |
| JP | 2005-057104 | A | 3/2005 |
| JP | 2014-204054 | A | 10/2014 |
| JP | 2014-225590 | A | 12/2014 |
| KR | 10-2015-0015641 | A | 2/2015 |
| TW | 201517071 | A | 5/2015 |

OTHER PUBLICATIONS

An Office Action; "Notification of Preliminary Rejection," issued by the Korean Intellectual Property Office dated Sep. 21, 2017, which corresponds to Korean Patent Application No. 10-2016-0071793 and is related to U.S. Appl. No. 15/175,655.

An Office Action; "Notification of Reasons for Refusal," Mailed by the Japanese Patent Office dated Aug. 7, 2018, which corresponds to Japanese Patent Application No. 2016-022323 and is related to U.S. Appl. No. 15/175,655; with English language translation.

* cited by examiner

METHOD FOR MANUFACTURING CERAMIC ELECTRONIC COMPONENT, AND CERAMIC ELECTRONIC COMPONENT

CROSS REFERENCE TO RELATED APPLICATIONS

This application claims benefit of priority to Japanese Patent Application 2015-120751 filed Jun. 16, 2015, and to Japanese Patent Application No. 2016-022323 filed Feb. 9, 2016, the entire content of which is incorporated herein by reference.

TECHNICAL FIELD

The present disclosure relates to a method for manufacturing a ceramic electronic component, and a ceramic electronic component, and particularly relates to formation of an electrode of a ceramic electronic component.

BACKGROUND

In the related art, it is common as a method for forming external electrodes of a ceramic electronic component to apply an electrode paste to both end surfaces of a sintered ceramic body, bake the paste to form base electrodes, and then form upper layer electrodes on the base electrodes by plating. However, this method has a problem of complicating the manufacturing steps and causing the cost increase, because the step of applying a paste and the heating step associated with the baking are necessary for the formation of the base electrodes.

Further, the method has a problem of an applied shape limited in applying a conductive paste in the formation of the base electrodes. For example, in the case of forming a conductive paste by a dip method at both ends of a ceramic body having a rectangular parallelepiped shape, the conductive paste is applied to not only both of the end surfaces of the ceramic body, but also four side surfaces adjacent to both of the end surfaces so as to wrap around the side surfaces. Therefore, finally formed external electrodes have shapes extending to both of the end surfaces and the four side surfaces adjacent to the end surfaces.

In place of such a method for forming electrodes in the related art, there is proposed a method for forming external electrodes just by plating (Japanese Patent Application Laid-Open No. 2004-40084). According to this method, a plurality of ends of internal electrodes is exposed on an end surface of a ceramic body with the ends in proximity to each other, dummy terminals referred to as anchor tabs are exposed in proximity on the same end surface as the ends of the internal electrodes, and the ceramic body is subjected to electroless plating to cause plated metals to grow with the ends of the internal electrodes and the anchor tabs as nuclei, thereby forming external electrodes.

However, according to this method, the ends of the plurality of internal electrodes and the anchor tabs have to be exposed in proximity in an external electrode formation part of the ceramic body, thus resulting in a disadvantage of complicating the manufacturing steps and of causing the cost increase. In addition, the surface on which the plated metals are formed is limited to the surface on which the ends of the internal electrodes and the anchor tabs are exposed, and thus it is not possible to form an external electrode on any part.

On the other hand, Japanese Patent Application Laid-Open Nos. 2000-223342, 2000-243629, and 11-176685 each disclose forming an electrode over the entire surface of ferrite constituting an inductor, and then burning off the electrode through laser irradiation, thereby forming a coil pattern. In that regard, these documents disclose the fact that heat of the laser spreads to not only the electrode but also the ferrite thereunder, thereby changing some of the ferrite properties to a conducting property or a lower resistance (see paragraph 0005 in Japanese Patent Application Laid-Open No. 2000-223342, paragraph 0004 in Japanese Patent Application Laid-Open No. 2000-243629, and paragraph 0005 in Japanese Patent Application Laid-5 No. 11-176685). However, these documents disclose only burning off the electrode through the laser irradiation, and in addition, describe the fact that the heat of the laser adversely affects characteristics as an inductor.

SUMMARY

Therefore, an object of the present disclosure is to propose a manufacturing method that is capable of forming an electrode on any part of a surface of a sintered ceramic body in accordance with a simple approach, and a ceramic electronic component manufactured by the method.

In order to achieve the object described above, the present disclosure provides a method for manufacturing a ceramic electronic component, which includes the following steps of:

A: preparing a sintered ceramic body containing a metal oxide;

B: locally heating an electrode formation region on a surface of the ceramic body to partially lower resistance of the ceramic body, thereby forming a low-resistance portion; and C: subjecting the ceramic body to plating to deposit a plated metal serving as an electrode on the low-resistance portion, and causing a growth of the plated metal to extend over the entire electrode formation region.

The present disclosure has focused on the locally heating of an electrode formation region on a surface of a sintered ceramic body, thereby lowering resistance of the heated part or making the heated part conducting, and subjecting the ceramic body to plating, thereby making it possible to use the low-resistance portion as a deposition starting point of a plated metal. The low-resistance portion (or conductor part) refers to a part where a metal oxide constituting a ceramic body is modified due to local heating, and a resistance value is lower than a resistance value of the metal oxide. When the locally heated ceramic body is subjected to plating, the plated metal is first deposited on the low-resistance portion, and the plated metal with the deposited plated metal as a nucleus rapidly grows, and thereby an electrode covering the entire electrode formation region can be formed efficiently. Therefore, the step of forming an electrode is simplified without need for any complicated step such as applying and baking a conductive paste in the related art. Further, since there is no need to expose a plurality of internal electrodes or anchor tabs in proximity on end surfaces of a ceramic body as in Japanese Patent Application Laid-Open No. 2004-40084, the electrode shape is not limited, and in addition, the manufacturing steps are simplified, and it is possible to reduce the cost.

The low-resistance portion may include a reduced layer obtained by partially reducing the metal oxide contained in the ceramic body. The metal oxide is partially reduced to make the metal oxide conducting or semiconducting, and the plated metal becomes more likely to be deposited. Further, a configuration may be adapted such that a surface layer of the reduced layer is partially or entirely covered with a reoxidized layer. In the case where the reoxidized layer is formed, there is an effect of enabling suppression of oxidation of the reduced layer present in the lower layer, and suppression of change of the reoxidized layer itself with time. Moreover, since the reoxidized layer is a type of semiconductor, and has a resistance value lower than a resistance value of the metal oxide as an insulator, the plated metal is likely to be deposited on the reoxidized layer. It is to be noted that since the reoxidized layer is formed, for example, in the form of a thin film on the order of nm, there is also a possibility that media balls used in electrolytic plating collide against the reoxidized layer, thereby partially peeling the reoxidized layer, or a plating solution cause erosion into the reoxidized layer, thereby resulting in plating attached onto the reduced layer present under the reoxidized layer.

The electrode according to the present disclosure is not limited to an external electrode as long as the electrode is formed on the surface of the ceramic body, but may be any electrode. For example, the electrode may be a coil-shaped electrode or a wiring electrode. As a method for the local heating, there are various methods such as, for example, laser irradiation, electron beam irradiation, or local heating with the use of an image furnace. Among them, the laser irradiation is advantageous in that a position of irradiating the ceramic body with the laser can be changed quickly.

According to the present disclosure, since the electrode formation region is just locally heated and subjected to plating, the electrode can be formed on any part. For example, a method in the related art using a conductive paste has difficulty in forming deformed electrodes, that is, external electrodes (L-shaped form as viewed from a side surface) on both end surfaces and one side surface adjacent to the end surfaces, or forming a plurality of external electrodes at an interval on one side surface, but according to the present disclosure, even such external electrodes in any shape can be formed easily. The local heating only needs to be applied to a surface layer part of the ceramic body, and thus has substantially no influence on characteristics as a ceramic electronic component (for example, inductor).

As a method for the plating, both electrolytic plating and electroless plating are possible, but an electrolytic plating method is preferred. That is, an object to be plated needs to be conductive in the electrolytic plating method. Since the low-resistance portion formed by the method according to the present disclosure has conductivity, the density of current flowing through the low-resistance portion during electrolytic plating becomes higher than that in the other part, and the plated metal is deposited rapidly on the low-resistance portion. In a plating method in the related art, in the case of wishing to leave a part of the ceramic body without being plated, it has been necessary to coat the part in advance with an anti-plating material. According to the present disclosure, a plated electrode extends rapidly over the electrode formation region with the low-resistance portion as a nucleus, while a growth rate of a plated electrode is low because a part other than the electrode formation region has an insulating property without any conductive part as a nucleus. Therefore, the plated metal can be grown selectively in the electrode formation region, without coating with the anti-plating material. Further, since the plated metal formed by electrolytic plating on the low-resistance portion is larger in thickness than that in another part, fixing strength of the plated electrode to the ceramic body advantageously increases.

The present disclosure can also be applied to electronic components including internal electrodes. For example, for a ceramic body having a rectangular parallelepiped shape, a low-resistance portion may be formed by laser irradiation or the like on a surface on which ends of internal electrodes are exposed, and an external electrode may be formed by plating so as to cover the ends of the internal electrodes. The electrode can be formed on any surface as long as the surface can be subjected to local heating such as laser processing. For example, it is also possible to form no electrode on either of width-direction side surfaces. As for an electronic component that has no external electrode formed on either of width-direction side surfaces, when this electronic component is mounted at a high density, the insulating distance to an electronic component adjacent in the width direction can be ensured, and it is possible to reduce the risk of short circuits. Therefore, further high-density mounting becomes possible. Further, when an external electrode is formed only on a lower surface (a bottom surface) of a ceramic body, it is possible to further reduce the risk of causing short circuits between the electrode and surrounding electronic components because of mounting only on the bottom surface.

The present disclosure can also be applied to, for example, wound coil components. That is, a configuration may be adopted such that the ceramic body is a ferrite core including flanges at both ends, and a winding core therebetween, the winding core of the ferrite core has a coil-shaped low-resistance portion formed by laser processing or the like, the flanges of the core have external electrode-shaped low-resistance portions formed by laser processing or the like, the coil-shaped low-resistance portion is connected to the external electrode-shaped low-resistance portions, and a plated electrode is continuously formed on the coil-shaped low-resistance portion and the external electrode-shaped low-resistance portions. In this case, since it is possible to form both the coil part and the external electrode part by laser processing or the like, the manufacture is further simplified. It is to be noted that the electrode on the coil part can be thicker than the external electrodes by a method such as adjusting laser intensity.

Further, a configuration may be adopted such that the ceramic body is a ferrite core including flanges at both ends, and a winding core therebetween, a wire is wound around a peripheral surface of the winding core, the low-resistance portion is formed on each of surfaces of the flanges, electrodes including a plated metal are formed on each of the low-resistance portions of the flanges, and the electrodes are connected to both ends of the wire. In this case, since the wound part is formed with the metal wire, a high magnetic efficiency is high, and since the external electrodes can be thin-wall electrodes according to the present disclosure, inductors with high Q values can be realized with a small eddy current loss.

When a laser is used as the method for the local heating, energy of the laser is concentrated in a narrow region, and thus the ceramic body is partially melted and solidified to form linear or dotted laser irradiation marks on the surface of the ceramic body, and low-resistance portions are formed around the marks. The depths and areas of the laser irradiation marks and low-resistance portions can be adjusted by the laser irradiation energy (wavelength, output, and the like). Since the plated metals deposited on the low-resistance portions are fixed along inner walls of the depressed laser irradiation marks, an anchor effect thereof can enhance the fixing strength of the plated metals (electrodes) to the ceramic body.

The electrode formation region may be densely irradiated with the laser such that low-resistance portions are present almost without any gap. In this case, since the low-resistance portions are also continuously formed, the plated metals are deposited and grown rapidly, and it is possible to reduce plating time. It is to be noted that the term "densely irradiating" refers to the fact that an interval between spot centers of laser irradiation is equal to or smaller than the area width of a low-resistance portion. That is, the term refers to $D \leq W$ when the interval between spot centers of laser irradiation is denoted by D, and the diameter of a spot (the area width of the low-resistance portion) is denoted by W.

When the electrode formation region is densely irradiated with the laser as described above, a large number of shots is required, which takes processing time. Therefore, the electrode formation region may be dispersedly irradiated with the laser at a predetermined distance, thereby dispersedly forming more than one low-resistance portion in the electrode formation region, and the plated metals deposited on the low-resistance portions are grown with the metals as nuclei, and the plating may be continued until the plated metals are connected to each other. Here, the term "dispersedly irradiating" refers to the fact that the interval between spot centers of laser irradiation is larger than the area width of a low-resistance portion. That is, the term refers to $D > W$ when the interval between spot centers of laser irradiation is denoted by D, and the diameter of a spot (the area width of the low-resistance portion) is denoted by W. An advantage of the plating is that once the plated metal is deposited on a part, the plated metal rapidly grows around with the part as a nucleus. With the utilization of the advantage, a homogeneous electrode can be formed over the entire electrode formation region, because after the deposition of plated metals on the plurality of dispersed low-resistance portions, the plated metals grow over a region other than the low-resistance portions with the metals as nuclei. Therefore, high-quality electrodes can be formed without dense laser irradiation, and the laser processing time can be shortened.

An example of typical ceramic materials that can be lowered in resistance or made conducting by laser irradiation includes ferrite. Ferrite is ceramics containing an iron oxide as its main component, and examples thereof include spinel ferrite, hexagonal ferrite, and garnet ferrite. Irradiating the ferrite with a laser increases temperature of the irradiated part, and a surface layer part of the insulating ferrite is modified to be conductive. Examples of ferrite for use in inductors include Ni—Zn based ferrite and Ni—Cu—Zn based ferrite. In the case of the Ni—Zn based ferrite, some of Fe contained in the ferrite is believed to be reduced by the laser irradiation, and there is further a possibility that Ni and/or Zn be also reduced. In the case of the Ni—Cu—Zn based ferrite, Fe and/or Cu contained in the ferrite are believed to be reduced, and there is further a possibility that Ni and/or Zn be also reduced.

As described above, according to the present disclosure, the electrode formation region of the sintered ceramic body is locally heated to form the low-resistance portion, the ceramic body is subjected to plating to deposit the plated metal on the low-resistance portion, and the plated electrode is grown over the electrode formation region. Thus, electrodes can be formed by a simple method. Moreover, since the electrode can be formed on any part as long as the part is a region that can be locally heated, electrodes in any shape can be formed simply.

DETAILED DESCRIPTION

Figure 1:
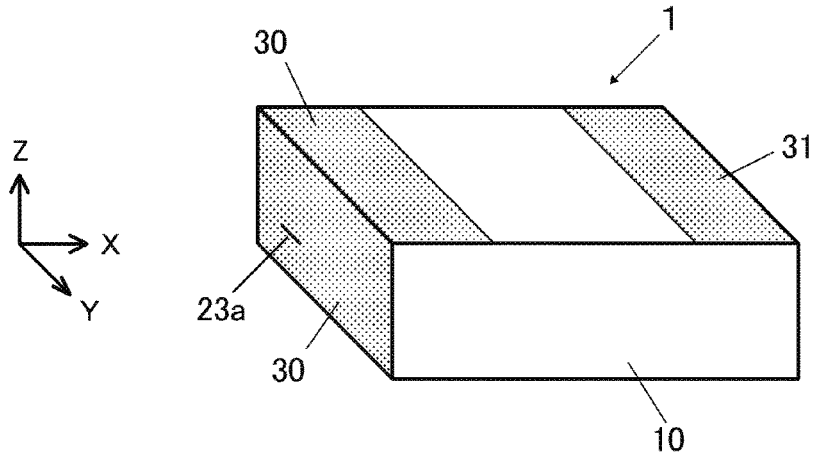
FIG. 1 is a perspective view of a first example of a ceramic electronic component according to the present disclosure.

FIG. 1 shows a chip-type inductor 1 that is an example of a ceramic electronic component according to the present disclosure. The inductor 1 includes a sintered ceramic body 10, and external electrodes 30, 31 are formed at both ends in the length-direction of the ceramic body 10. A shape of the inductor 1 according to this example is a rectangular parallelepiped having a large dimension in the X-axis direction as compared with dimensions in the Y-axis and Z-axis directions as shown in FIG. 1.

Figure 2:
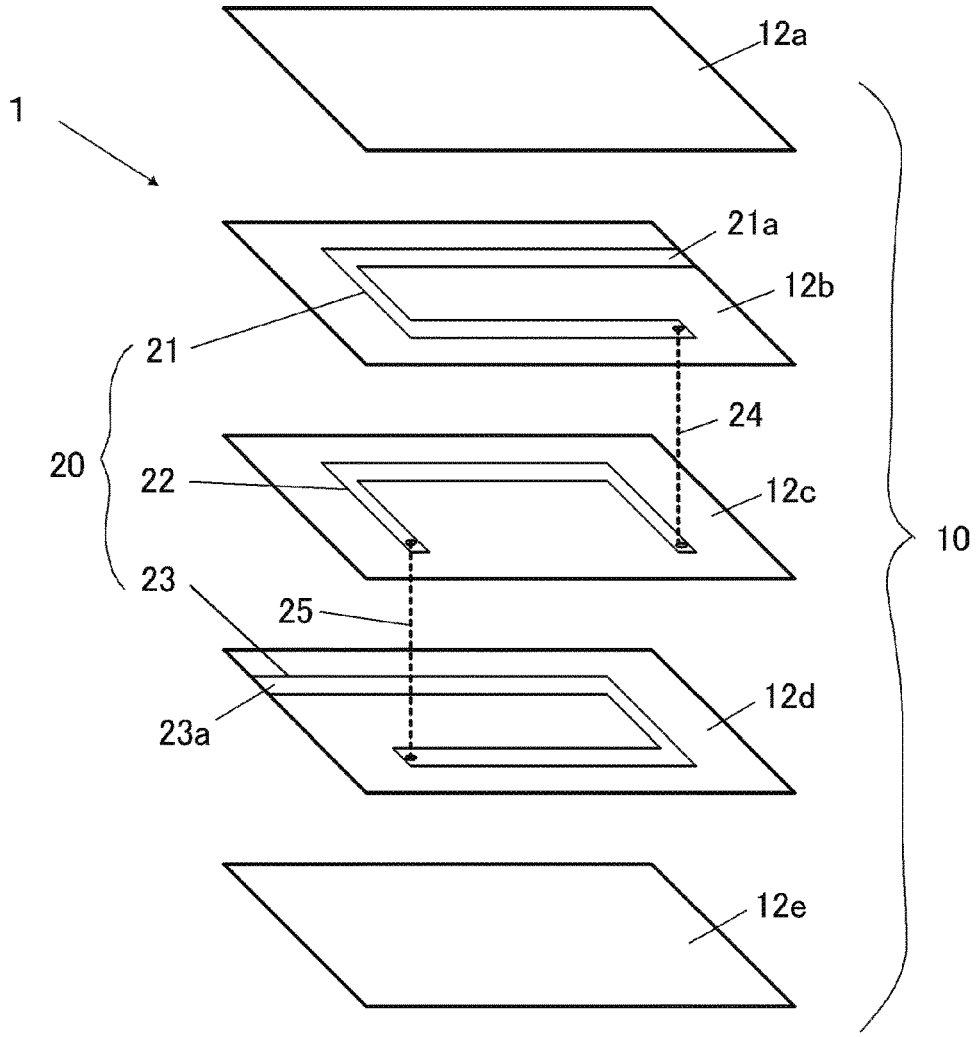
FIG. 2 is an exploded perspective view of the ceramic electronic component shown in FIG. 1.

The ceramic body 10 is obtained by, as shown in FIG. 2, stacking insulator layers 12*a* to 12*e* mainly containing, for example, Ni—Zn based ferrite or Ni—Cu—Zn based ferrite, and sintering the layers. The insulator layers 12*a* to 12*e* are stacked in order in the vertical direction (Z-axis direction). Coil conductors 21 to 23 constituting internal electrodes 20 are formed on each of the intermediate insulator layers 12*b* to 12*d*, except for the insulator layers 12*a*, 12*e* at both upper and lower ends. These three coil conductors 21 to 23 are interconnected by via conductors 24, 25, and formed spirally as a whole. The coil conductors 21 to 23 and the via conductors 24, 25 are formed with a conductive material such as Au, Ag, Pd, Cu, and Ni. The coil conductor 21 has one end (extended part) 21*a* exposed on one end surface in the X-axis direction of the ceramic body 10, and the coil conductor 23 has one end (extended part) 23*a* exposed on the other end surface in the X-axis direction of the ceramic body 10. It is to be noted that while an example where the coil conductors to 23 form a coil of two turns has been provided in this example, the number of turns is any number, and the shapes of the coil conductors and any number of the insulator layers can also be selected. Moreover, the number of the insulator layers 12*a*, 12*e* including no coil conductor is also any number.

The external electrodes 30, 31 are, as shown in FIG. 1, formed in an L-shaped form as viewed from the side surface, so as to cover both end surfaces in the X-axis direction of the ceramic body 10, and to partially cover an upper surface (a bottom surface in the case of mounting) thereof. That is, when the ceramic body 10 is viewed from the Y direction, the external electrodes 30, 31 are each formed in an L-shaped form. The external electrode 30 is connected to the extended part 23*a* of the coil conductor 23, and the external electrode 31 is connected to the extended part 21*a* of the coil conductor 21. It is to be noted that the external electrodes 30, 31 are formed by plating as described later, and Cu, Au, Ag, Pd, Ni, Sn, or the like is used as a material thereof. It is to be noted that the external electrodes 30, 31 themselves may include multiple layers of plated metals.

Figure 3A:
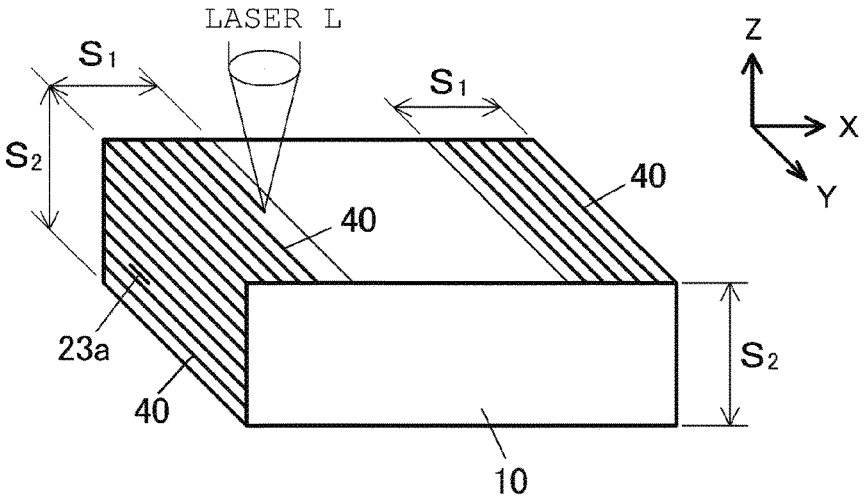
FIGS. 3A to 3C are perspective views showing external electrode formation regions irradiated with a laser.
Figure 3B:
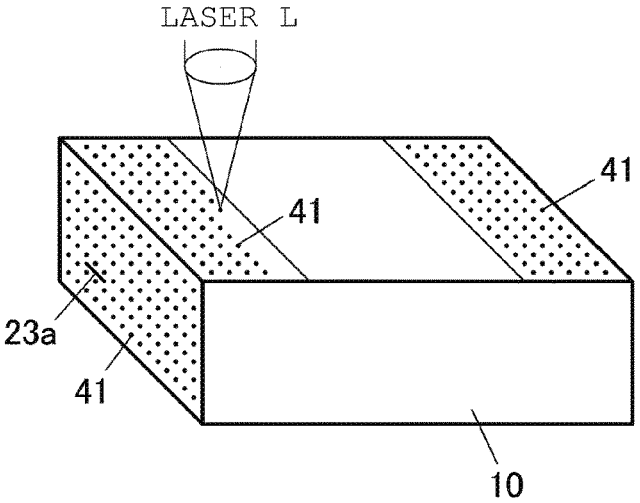
Figure 3C:
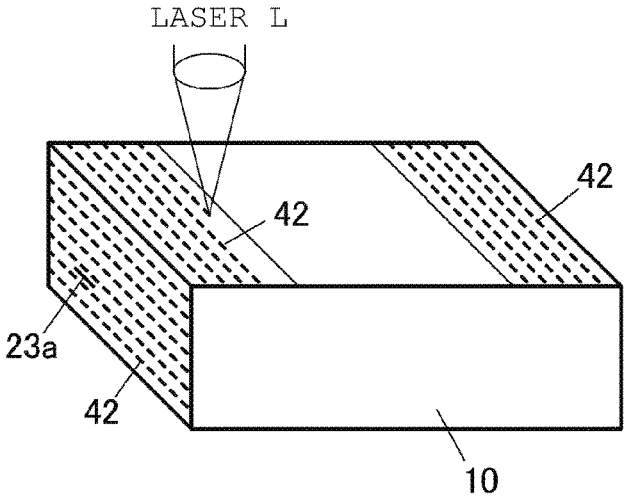

FIGS. 3A to 3C show external electrode formation regions S1, S2 irradiated with a laser L before the formation of the external electrodes 30, 31 onto the ceramic body 10. FIG. 3A shows an example of scanning along the Y-axis direction while continuously irradiating with the laser L (or an example of moving the ceramic body 10 in the Y-axis direction). It is to be noted that the scanning direction is any direction, and may be the X-axis direction (or the Z-axis direction), or in a zigzag manner or a go-around manner. The irradiation with the laser L forms a large number of linear laser irradiation marks 40 on the surface of the ceramic body 10. It is to be noted that while FIG. 3A shows an example of forming the linear laser irradiation marks 40 at intervals in the X-axis direction, the laser irradiation marks 40 may be formed densely so as to overlap each other. FIG. 3B shows an example of irradiating with the laser L as dots. In this case, a large number of dotted laser irradiation marks 41 are dispersedly formed on the surface of the ceramic body 10. FIG. 3C shows an example of irradiating the laser L in a dashed line manner. In this case, a large number of dashed laser irradiation marks 42 are dispersedly formed on the surface of the ceramic body 10. In each case, it is desirable to irradiate the entire external electrode formation regions S1, S2 uniformly with the laser L.

FIGS. 4A to 4D schematically show an example of a process for forming an external electrode. In particular, FIGS. 4A to 4D show a case where external electrode formation regions are irradiated with a laser L in a linear manner at predetermined intervals.

Figure 4A:
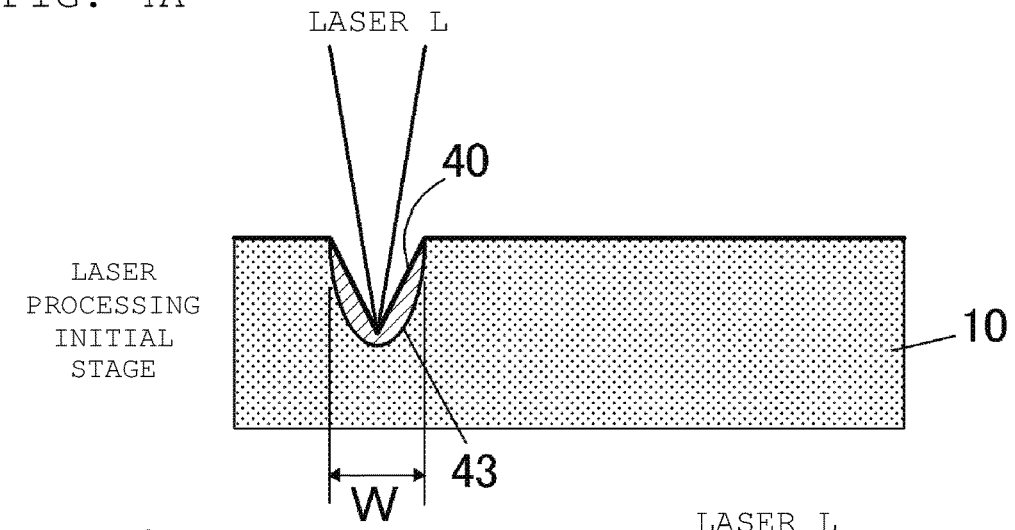
FIGS. 4A to 4D are sectional views showing steps of forming an external electrode.

FIG. 4A shows a state where the external electrode formation regions on a surface of a ceramic body 10 are first irradiated with the laser, and thereby a laser irradiation mark 40 having a V-shaped or U-shaped section is formed on the surface of the ceramic body 10. It is to be noted that while FIG. 4A shows an example of focusing the laser L on one point, a spot irradiated with the laser L may have a certain area in practice. This laser irradiation mark 40 is a mark formed by a surface layer part of the ceramic body 10 that is melted and solidified by the laser irradiation. Since a central part of the spot has the highest energy, a ceramic material of the part is likely to be modified, and the laser irradiation mark 40 obtains a substantially V-shaped or substantially U-shaped section. In the vicinity including an inner wall surface of the laser irradiation mark 40, an insulating material (ferrite) constituting the ceramic body is modified to form a conductor part or a low-resistance portion 43 that has a lower resistance value than a resistance value of the insulating material. Specifically, when the ceramic body 10 is Ni—Zn based ferrite, some of Fe contained in the ferrite is believed to be reduced by the laser irradiation, and there is further a possibility that Ni and/or Zn be also reduced. When the ceramic body 10 is Ni—Cu—Zn based ferrite, Fe and/or Cu contained in the ferrite are believed to be reduced, and there is further a possibility that Ni and/or Zn be also reduced. The depth and area of the low-resistance portion 43 can be varied depending on laser irradiation energy or irradiation range.

Figure 4B:
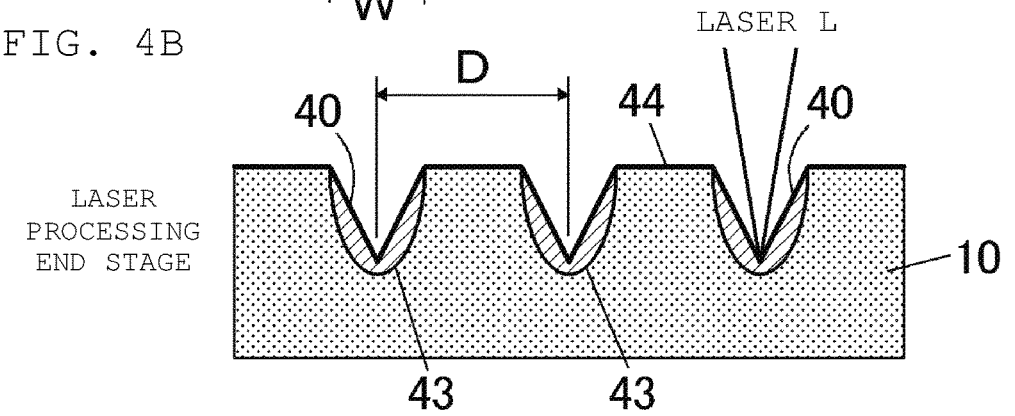

FIG. 4B shows a state where a plurality of the laser irradiation marks 40 is formed at an interval D in external electrode formation regions by repeating laser irradiation. In this example, since the interval D between spot centers of the laser irradiation is larger than an area width (for example, an average value of diameters) W of the low-resistance portion 43, insulating regions 44 other than low-resistance portions are present between the respective laser irradiation marks 40. The regions 44 are regions where the original insulating material constituting the ceramic body is exposed without being modified.

Figure 4C:
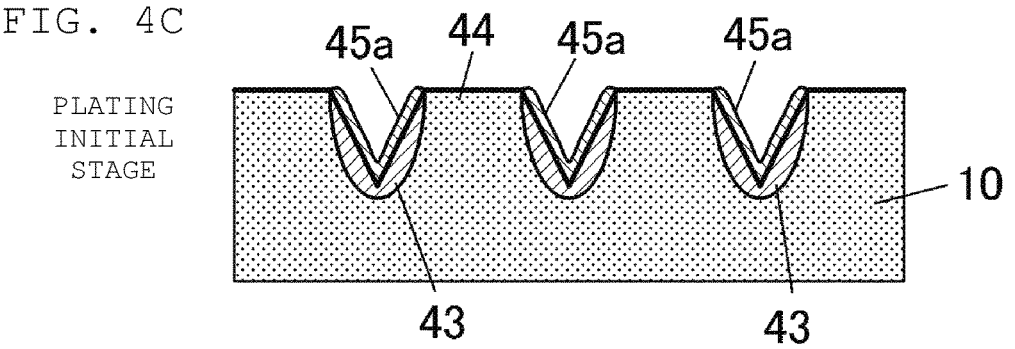

FIG. 4C shows a state of an initial stage where the ceramic body 10 having the low-resistance portions 43 formed thereon by the laser irradiation as described above is immersed in a plating solution to carry out electrolytic plating. Since a current density in the conductive low-resistance portions 43 becomes higher than that in other parts, plated metals 45*a* are deposited only on surfaces of the low-resistance portions 43 and are still not deposited on the insulating regions 44. That is, no continuous external electrode is formed at this stage.

Figure 4D:
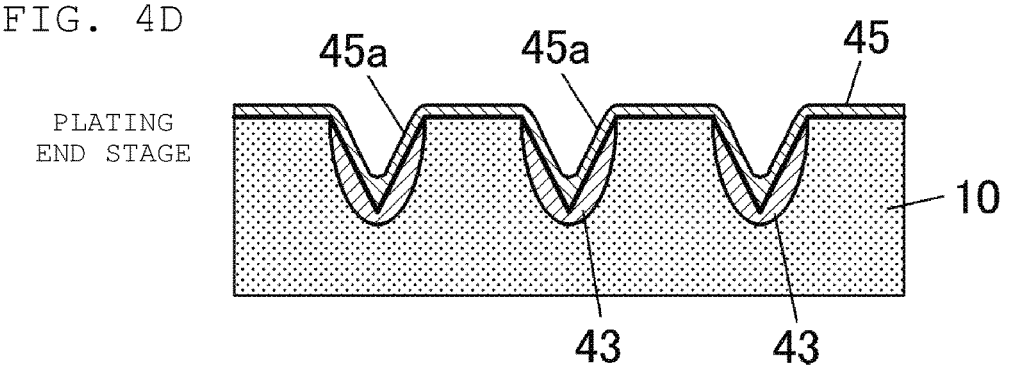

FIG. 4D shows a state of an end stage where the electrolytic plating is carried out. Continuing the plating extensively grows the plated metals 45*a* deposited on the low-resistance portions 43 with the metals as nuclei, thereby causing the metals to extend onto the insulating regions 44 adjacent to the low-resistance portions 43. A continuous external electrode can be formed by continuing the plating until the adjacent plated metals 45*a* are connected to each other. Since a growth rate of the plated metals in the regions other than the external electrode formation regions is lower than a growth rate of the plated metals in the external electrode formation regions irradiated with the laser, the plated metals can be grown selectively in the external electrode formation regions, without rigorously controlling the plating time. The formation time or thickness of the external electrode can be controlled by controlling the plating time, voltage, or current. Further, an external electrode with a multilayer structure can also be formed by carrying out additional plating onto the external electrode 45 formed by the first plating. In this case, additional plating time is short because the external electrode 45 serving as a base has already been formed.

EXPERIMENTAL EXAMPLE

An experimental example where an external electrode was actually formed will be described below.

(1) A sintered ceramic body including Ni—Cu—Zn based ferrite was irradiated with a laser while scanning back and forth. Processing conditions are as follows, but a wavelength may fall within any range such as from 532 nm to 10620 nm. An irradiation interval means the distance between spot centers of going and returning in the case of laser scanning back and forth.

TABLE 1

| Laser Processing Conditions | |
|---|---|
| Wavelength | 1064 nm (YVo4) |
| Output | 14 A |
| Scan Speed | 200 mm/s |
| Q switch Frequency | 20 kHz |
| Irradiation Interval (pitch) | 30 μm |
| Spot Diameter | 70 μm |
| Energy Density | 1 J/sec |

(2) The ceramic body subjected to the laser irradiation was subjected to electrolytic plating under the following conditions. Specifically, barrel plating was used.

TABLE 2

| Plating Conditions | |
|---|---|
| Plating Solution | Plating Solution of Copper Pyrophosphate |
| The Number of Revolutions [rpm] | 24 rpm |
| Current [A] | 12 A |
| Temperature [° C.] | 55° C. |
| Time | 8 min |

As a result of carrying out the plating under the conditions as described above, a favorable Cu external electrode of 20 μm in average thickness was successfully formed on a surface of the ceramic body. It is to be noted that a similar result was obtained even in the case of using Ni—Zn based ferrite. Moreover, a copper sulfate plating solution, a copper cyanide plating solution, and the like can be use as the plating solution, besides the copper pyrophosphate plating solution.

—Evaluation—

A sample obtained by irradiating Ni—Cu—Zn based ferrite with the laser and a sample obtained without irradiating Ni—Cu—Zn based ferrite with laser were each evaluated for valences of Fe, Cu, and Zn on a sample surface by XPS (X-ray photoelectron spectroscopy) and K-edge XAFS (X-ray absorption fine structure) for Fe, Cu, and Zn using conversion electron yield. As a result of the XPS, no metal component was able to be detected on a surface layer part of the sample subjected to the laser irradiation, and the metal components were able to be detected on the lower layer thereof. Moreover, as a result of the XAFS, the metal component of Cu was able to be detected on the surface layer part of the sample subjected to the laser irradiation. On the other hand, as a result of the XAFS, the metal component of Fe was not able to be detected on the surface layer part of the sample subjected to the laser irradiation, but a semiconductor component of Fe and an insulator component thereof were able to be detected thereon. It was also found that a ratio of $Fe_2$+ to $Fe_3$+ in the lower layer was higher than a ratio in the whole ceramic body. From the foregoing, it is presumed that heat generated by the laser processing decomposed metal oxides contained in the ferrite to reduce metal elements of the ferrite in the lower layer of the ceramic body, and the remaining heat led to reoxidation of the surface layer part of the ceramic body.

Figure 5:
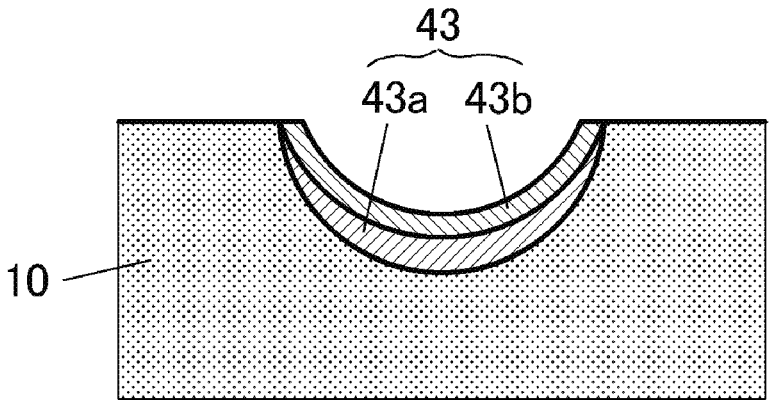
FIG. 5 is an enlarged sectional view of an example of a low-resistance portion.

FIG. 5 shows an example of a section structure of the thus formed low-resistance portion 43, and in the section structure, a reduced layer 43*a* is formed in a lower layer, and a surface layer thereof is covered with a reoxidized layer 43*b* including semiconductor and/or insulator components. The reduced layer and the reoxidized layer constitute the low-resistance portion. It is to be noted that the laser irradiation is not limited to that in an air atmosphere, and the laser irradiation may be carried out in vacuum or in a $N_2$ atmosphere although there is a possibility that no reoxidized layer be formed when the laser irradiation is carried out in vacuum or in a $N_2$ atmosphere.

When the reoxidized layer described above is formed, the following effects are conceivable. That is, $Fe_3O_4$ formed as the reoxidized layer has a property of being less likely to be reoxidized at normal temperature, and also has an effect of enabling suppression of oxidation of the reduced layer present in the lower layer, and suppression of change of the reoxidized layer itself with time. Moreover, the reoxidized layer is a type of semiconductor, and has a resistance value lower than a resistance value of ferrite as an insulator. Therefore, plated metals are likely to be deposited on the reoxidized layer.

Figure 6A:
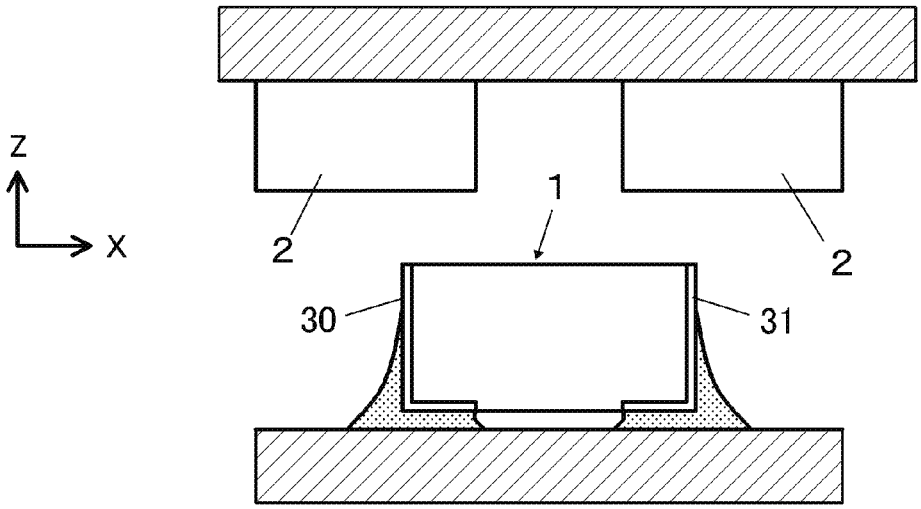
FIGS. 6A and 6B are views showing examples of mounting a ceramic electronic component according to the present disclosure.
Figure 6B:
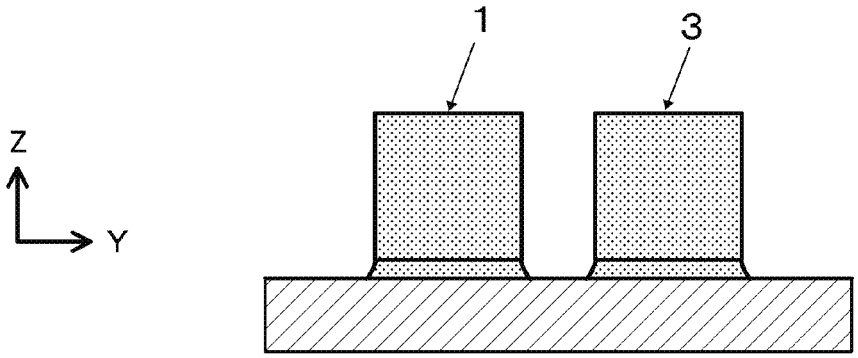

In the present embodiment, the external electrodes 30, 31 are each formed in an L-shaped form as viewed from the side surface (when the ceramic body 10 is viewed from the Y direction). That is, the external electrodes 30, 31 are formed only on both end surfaces and a bottom surface (in mounting) of the inductor 1, and formed neither on an upper surface (in mounting) nor on either of side surfaces in the Y direction. Therefore, as shown in FIG. 6A, even when other electronic components 2 or conductors are present in proximity above the inductor 1 in a state of mounting, it is possible to reduce the risk of causing short circuits. Further, as shown in FIG. 6B, even when another electronic component 3 is mounted adjacent in the Y direction of the inductor 1, the insulating distance to the adjacent electronic component 3 can be ensured, and the distance between solders applied to the external electrodes can also be ensured, because the external electrodes 30, 31 are not formed on either of the side surfaces in the Y direction of the inductor 1. Therefore, it is possible to reduce the risk of short circuits with the adjacent electronic component 3. As a result, in the case of the inductor 1 including the L-shaped external electrodes, further high-density mounting becomes possible. Further, there is also an effect of reduction in floating capacitance as compared with external electrodes in the related art.

FIGS. 7A to 7D show another example of the process for forming the external electrodes 30, 31, and in particular, shows a case of densely irradiating an external electrode formation region with a laser L. The term "densely irradiating" refers to the fact that an interval D between spot centers of laser irradiation is equal to or smaller than the area width (for example, an average value of diameters) W of each of low-resistance portions 43, and refers to a state where the low-resistance portions 43 formed under adjacent laser irradiation marks 40 are interconnected (see FIG. 7B). However, there is no need to connect all of the low-resistance portions 43. Therefore, the external electrode formation region of a ceramic body 10 is almost entirely covered with the low-resistance portions 43.

Figure 7A:
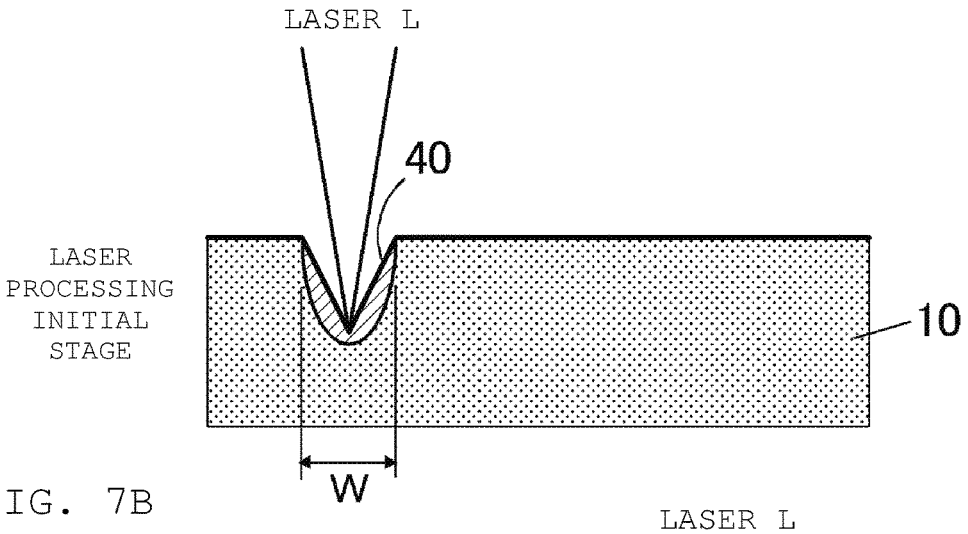
FIGS. 7A to 7D are sectional views showing another example of the steps of forming an external electrode.
Figure 7B:
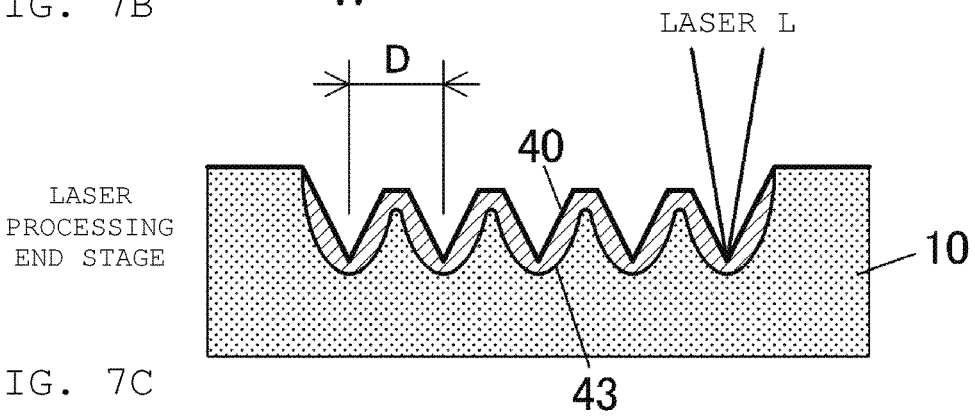
Figure 7C:
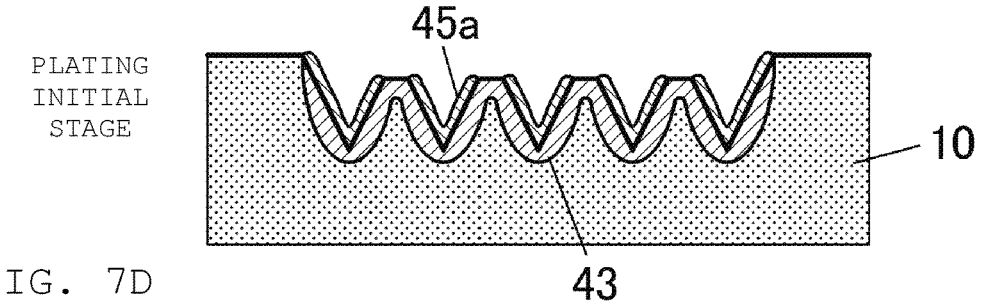
Figure 7D:
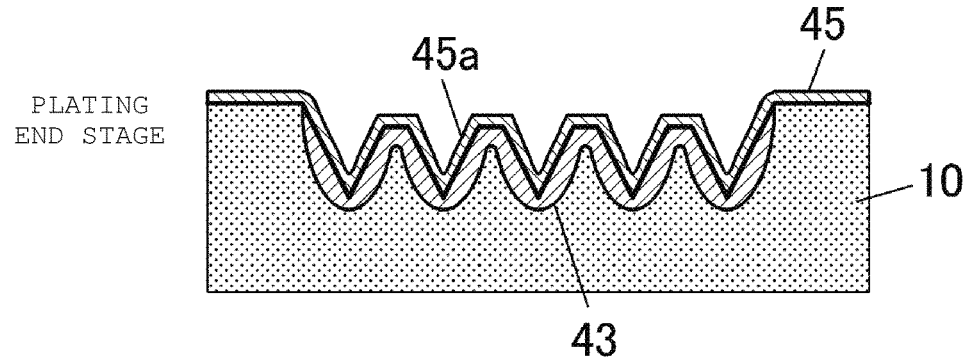

In this case, as shown in FIG. 7C, plated metals 45*a* are deposited on surfaces of the low-resistance portions 43 in a short period of time from the start of plating, but the adjacent plated electrodes 45*a* are rapidly connected to each other, because the plated electrodes 45*a* are present almost in proximity to each other. Therefore, a continuous external electrode 45 can be formed in a shorter period of time than in the case of FIGS. 4A to 4D.

As shown in FIGS. 7A to 7D, when the external electrode formation region is densely irradiated with the laser L, the laser irradiation marks 40 are also densely formed, and a surface of the ceramic body 10 is thus chipped away. Since the plated metal 45 is formed on the surface, the surface of the external electrode can be almost level with or lower than the surface of the ceramic body 10. Therefore, in combination with the reduced thickness of the external electrode itself, it is possible to suppress a projecting amount of the external electrode, and a smaller-size chip component can be realized.

Figure 8A:
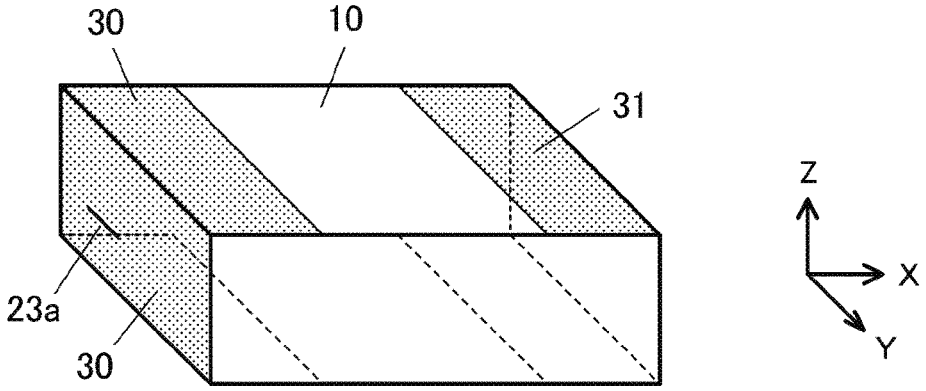
FIGS. 8A to 8C are perspective views showing several examples of ceramic electronic components according to the present disclosure.
Figure 8B:
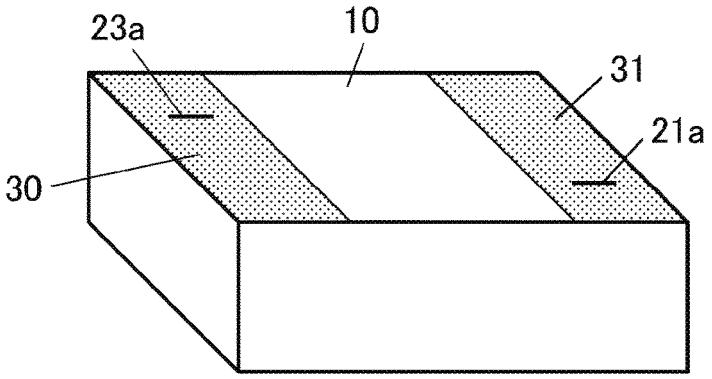
Figure 8C:
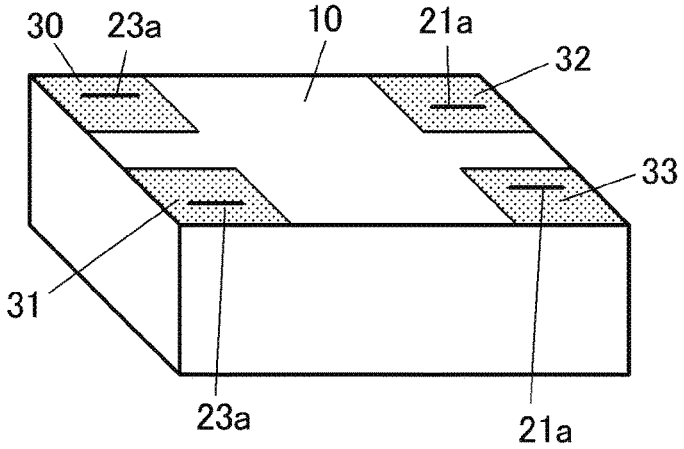

FIGS. 8A to 8C shows various forms of external electrodes formed with use of the present disclosure. FIG. 8A shows the form where external electrodes 30, 31 in a U-shaped form are formed at both ends of a ceramic body 10. As in the example in FIG. 1, extended parts 21*a*, 23*a* (21*a* is not shown) of internal electrodes are exposed on both end surfaces in the X direction of the ceramic body 10, and connected respectively to the external electrodes 30, 31. In this case, the external electrodes 30, 31 are formed on both of the end surfaces in the X direction of the ceramic body 10, and formed partially on upper and lower surfaces (both side surfaces in the Z direction) thereof, and no external electrode is formed on either of side surfaces in the Y direction. Therefore, this electronic component 1 can be mounted at a high density to be adjacent in the Y direction.

FIG. 8B shows the form where external electrodes 30, 31 are formed only at both ends of an upper surface (a bottom surface in mounting) of a ceramic body 10. No external electrode is formed on other surfaces. In this case, ends 21*a*, 23*a* of internal electrodes are not exposed on either of the end surfaces in the X direction of the ceramic body 10, but exposed only on an upper surface thereof in parallel with the X direction. The external electrodes 30, 31 are connected respectively to the ends 23*a*, 21*a* of the internal electrodes. In this case, insulator layers constituting the ceramic body 10 are stacked in the Y direction, not in the Z direction. Since the external electrodes are formed only on the bottom surface of the ceramic body 10, an electronic component suited for high-density mounting can be realized.

FIG. 8C shows the form where four external electrodes 30 to 33 in total are formed at both ends in the X-direction of an upper surface (a bottom surface in mounting) of a ceramic body 10. Also in this case, ends (not shown) of internal electrodes are not exposed on either of the end surfaces in the X direction of the ceramic body 10, but exposed only on the upper surface on which the external electrodes 30 to 33 are formed. As described above, the external electrodes with use of the method according to the present disclosure can be formed on any part without limitation as long as the part is a surface that can be subjected to laser processing and plating.

Figure 9:
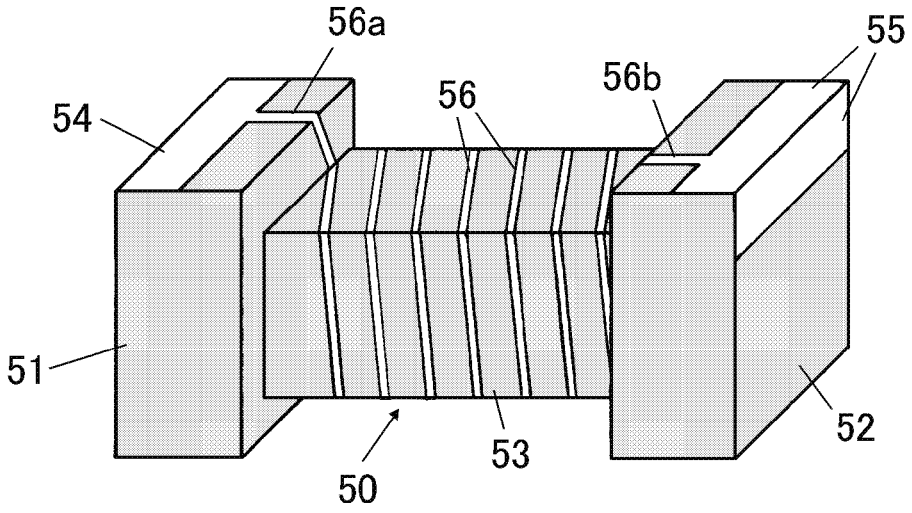
FIG. 9 is a view showing a wound inductor as an example of a ceramic electronic component according to the present disclosure.

FIG. 9 is an example of applying the present disclosure to electrode formation for a wound inductor. A ceramic body 50 is a core including flanges 51, 52 at both ends, and including a winding core 53 therebetween. Ni—Zn based ferrite, Ni—Cu—Zn based ferrite or the like can be used as a core material. External electrode formation regions on upper surfaces and end surfaces of the flanges 51, 52 of the core 50 have low-resistance portions formed by laser processing, and external electrodes 54, 55 formed by plating on the low-resistance portions. Moreover, a peripheral surface of the winding core 53 has a coil-shaped low-resistance portion formed by laser processing, and a coil electrode 56 formed by plating on the coil-shaped low-resistance portion. Since the coil-shaped low-resistance portion has both ends subjected to the laser processing so as to be continuous with the low-resistance portions of the external electrode formation regions, both ends 56*a*, 56*b* of the coil electrode 56 are connected by the plating to the external electrodes 54, 55, respectively.

According to this example, the coil-shaped low-resistance portion and the low-resistance portions for external electrodes can be formed continuously by laser processing. For example, a method of fixing a laser position and rotating and moving the core 50 in an axial direction can be used as the laser processing. Since the coil electrode 56 and the external electrodes 54, 55 can be formed simultaneously by the plating, the steps of manufacturing the inductor can be made more efficient, and it is possible to reduce the manufacturing cost. It is to be noted that a multilayer structure can be provided by subjecting the coil electrode 56 and the external electrodes 54, 55 to the plating a plurality of times. It is to be noted that the coil electrode 56 and the external electrodes 54, 55 are formed by the plating in this example, but in a wound inductor (ferrite core) with wire wound around a winding core, only external electrodes connected to the wire can also be formed by the plating.

As described above, when the coil electrode 56 and the external electrodes 54, 55 are formed by laser processing and plating, there is a possibility that the electrodes 56, 54, 55 substantially have an almost constant thickness. In particular, in the case of wishing to increase a generated magnetic flux of the coil electrode 56, it is desirable to make the thickness of the coil electrode 56 larger than the thicknesses of the external electrodes 54, 55. In such a case, for example, laser intensity of a laser with which the winding core 53 is irradiated may be made higher than laser intensity of a laser with which the external electrode regions are irradiated, or irradiation methods (for example, intermittent irradiation and continuous irradiation, scaling of irradiation range) for the laser with which the winding core 53 is irradiated and for the laser with which the external electrode regions are irradiated may be changed. The increased laser intensity makes a resistance value of the coil-shaped low-resistance portion lower than a resistance value of each of the low-resistance portions of the external electrode formation regions, or makes the depth of the coil-shaped low-resistance portion larger than the depth of each of the low-resistance portions of the external electrode formation regions. Thus, the thickness of the electrode 56 formed by plating on the coil-shaped low-resistance portion can be made larger than the thicknesses of the electrodes 54, 55 formed on the low-resistance portions of the external electrode formation regions.

Figure 10:
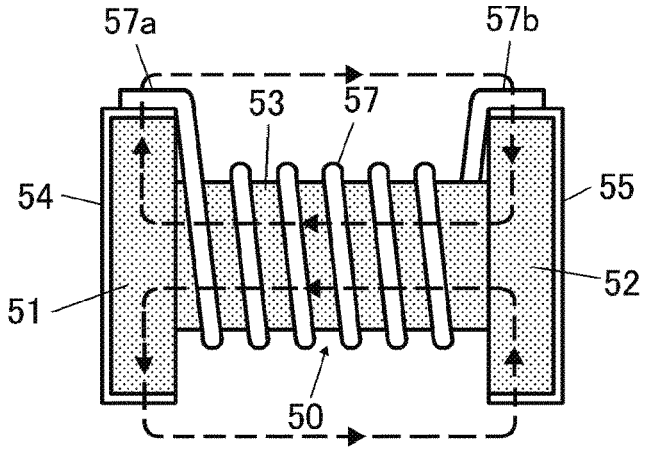
FIG. 10 is a view showing another example of a wound inductor according to the present disclosure.

FIG. 10 shows another application example of a wound inductor. The same parts as or parts corresponding to those in FIG. 9 will be denoted by the same reference numerals, and repeated description of the parts will be omitted. Low-resistance portions are formed by laser processing in external electrode formation regions on upper surfaces, outer surfaces and lower surfaces of flanges 51, 52 of a core 50, and external electrodes 54, 55 are formed by plating on the low-resistance portions. Therefore, the U-shaped external electrodes 54, 55 are formed as a whole in this example. Wire 57 is wound around a peripheral surface of a winding core 53, and both ends 57*a*, 57*b* of the wire are connected respectively to parts of the external electrodes 54, 55 formed on the upper surfaces of the flanges 51, 52. Parts of the external electrodes 54, 55, which are formed on the lower surfaces of the flanges 51, 52, are used as electrodes for mounting. It is to be noted that the external electrodes 54, 55 are not limited to the U-shaped electrodes, but may be formed, for example, only on the upper surfaces of the flanges 51, 52 (the surfaces connected to the wire 57).

In this example, since the external electrodes 54, 55 can be formed in a thin-fall fashion as compared with the wire 57, there is an effect of suppressing an eddy current loss. That is, interlinkage of magnetic fluxes (indicated by dashed arrows in FIG. 10) generated by the wire 57 and the external electrodes 54, generates a loss owing to an eddy current, and the eddy current loss is proportional to the square of the thicknesses of the external electrodes 54, 55 under the interlinkage. Since the external electrodes 54, 55 formed by the method according to the present disclosure can be formed in a thin-fall fashion as compared with commonly used external electrodes, it is possible to suppress the eddy current loss. Further, since use of the wire 57 as winding wire increases a magnetic flux density generated, inductors with high Q values can be obtained.

Figure 11:
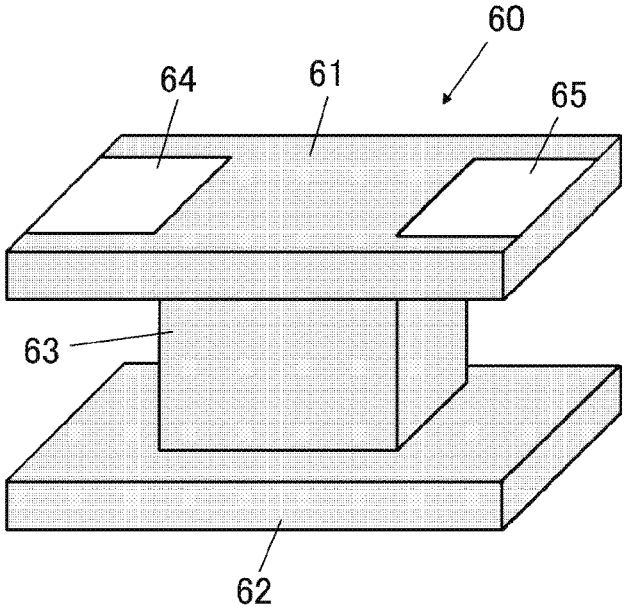
FIG. 11 is a view showing a longitudinally wound coil component as an example of a ceramic electronic component according to the present disclosure.

FIG. 11 shows an example of applying the present disclosure to a longitudinally coil component (inductor). A ceramic body 60 in this case is a ferrite core having flanges 61, 62 at both ends, and having a winding core 63 therebetween. Low-resistance portions are formed by laser processing in external electrode formation regions on an upper surface of one flange 61 of the core 60, and external electrodes 64, 65 are formed by plating on the low-resistance portions. Moreover, coated wire (not shown) is wound around a peripheral surface of the winding core 63, and both ends of the wire are connected respectively to the external electrodes 64, 65. It is to be noted that FIGS. 9 and 10 show the examples of forming the two external electrodes 64, 65, but in the case of using two lines of wire, four external electrodes may be formed on the flange 61.

Figure 12:
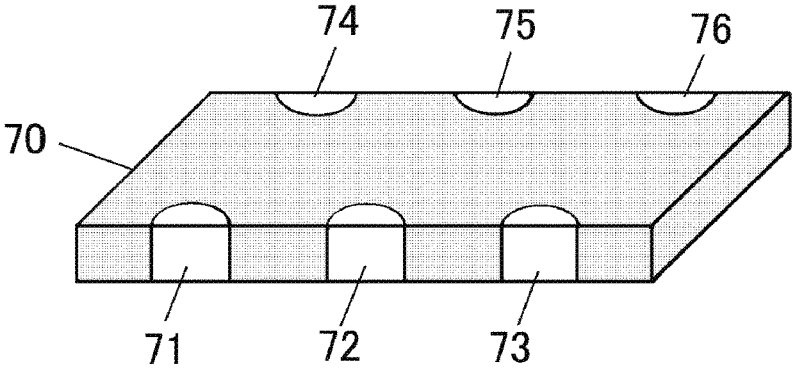
FIG. 12 is a view showing a multiterminal electronic component as an example of a ceramic electronic component according to the present disclosure.

FIG. 12 shows an example of applying the present disclosure to a multiterminal electronic component. This electronic component has a main body 70 including a ceramic body, and a plurality of (six here) external electrodes 71 to 76 is formed on both side surfaces in the longitudinal-direction of the main body 70. It is to be noted that the external electrodes 71 to 76 may partially extend to an upper surface or a lower surface of the ceramic body 70. The external electrodes 71 to 76 are connected to internal electrodes in the ceramic body 70, or a circuit section formed on an outer surface. The external electrodes 71 to 76 in this case are also formed by local heating such as laser processing, and by subsequent plating.

While the examples of applying the present disclosure to the formation of the external electrodes of the stacked inductor and the electrodes of the wound inductor (ferrite cores) have been provided, the present disclosure is not limited to these examples. The ceramic electronic components to which the present disclosure is directed are not limited to inductors, and the present disclosure is applicable to electronic components including a ceramic body that is modified by laser irradiation to form a low-resistance portion as deposition starting points for plated electrodes. That is, the material of the ceramic body is not limited to ferrite. Further, the structure of the electronic component is not limited to a structure including internal electrodes or a structure having a plurality of insulating layers stacked. While the examples of using electrolytic plating as a plating method have been provided, electroless plating may be used.

While the laser irradiation is used as a local heating method in the example described above, electron beam irradiation, heating with use of an image furnace, and the like are also applicable. In each case, since heat source energy can be focused to locally heat an external electrode formation region of a ceramic body, an electrical property in other regions are not impaired.

In the present disclosure, one laser may be divided, and a plurality of sites may be irradiated simultaneously with the laser.

Further, in the present disclosure, a focus of a laser may be shifted to widen the irradiation range of the laser, as compared with a case of a focused laser.

The present disclosure is not limited to the case of growing a lowermost layer of plated metal so as to extend over the entire electrode formation regions when a plurality of layers of plated metal is formed. The lowermost layer of plated metal may be grown so as to extend partially over electron formation regions, and an upper layer of plated metal may be grown so as to extend over the entire electrode formation regions.

What is claimed is:

1. A method for manufacturing a ceramic electronic component, the method comprising the steps of:

preparing a sintered ceramic body containing a metal oxide;

locally heating an electrode formation region on a surface of the ceramic body to partially lower resistance of the ceramic body, thereby forming a low-resistance portion; and subjecting the ceramic body to plating to deposit a plated metal serving as an electrode on the low-resistance portion, and causing a growth of the plated metal to extend over the entire electrode formation region.

2. The method for manufacturing the ceramic electronic component according to claim 1, wherein the low-resistance portion includes a reduced layer obtained by partially reducing the metal oxide contained in the ceramic body.

3. The method for manufacturing the ceramic electronic component according to claim 2, wherein a surface layer of the reduced layer is covered with a reoxidized layer.

4. The method for manufacturing the ceramic electronic component according to claim 1, wherein the local heating is any one of laser irradiation, electron beam irradiation, and local heating with an image furnace.

5. The method for manufacturing the ceramic electronic component according to claim 4, wherein more than one site in the electrode formation region is irradiated with a laser at a predetermined distance, thereby dispersedly forming more than one low-resistance portion in the electrode formation region, and plated metals deposited on the low-resistance portions are grown with the plated metals as nuclei, and the plating is continued until the plated metals are connected to each other.

6. The method for manufacturing the ceramic electronic component according to claim 4, wherein the electrode formation region is densely irradiated with a laser to form the continuous low-resistance portion in the electrode formation region, and the plated metal deposited on the low-resistance portion is grown with the plated metal as a nucleus, and the plating is continued until the plated metal extends over the entire electrode formation region.

7. The method for manufacturing the ceramic electronic component according to claim 1, wherein an electrolytic plating method is used for the plating.

8. The method for manufacturing the ceramic electronic component according to claim 1, wherein the ceramic body includes ferrite.

9. The method for manufacturing the ceramic electronic component according to claim 8, wherein the ceramic body includes Ni—Zn based ferrite, and the low-resistance portion is formed by partially reducing Fe contained in the ferrite.

10. The method for manufacturing the ceramic electronic component according to claim 8, wherein the ceramic body includes Ni—Cu—Zn based ferrite, and the low-resistance portion is formed by partially reducing at least one of Fe and Cu contained in the ferrite.

* * * * *